US011427381B1

(12) United States Patent
Jacobson

(10) Patent No.: US 11,427,381 B1
(45) Date of Patent: Aug. 30, 2022

(54) SELF-STACKING STRATEGICALLY PACKED AND COLLATED ENCLOSURE (SPACE) PLATFORM

(71) Applicant: David A Jacobson, Rochester, MI (US)

(72) Inventor: David A Jacobson, Rochester, MI (US)

( * ) Notice: Subject to any disclaimer, the term of this patent is extended or adjusted under 35 U.S.C. 154(b) by 0 days.

(21) Appl. No.: 17/346,204

(22) Filed: Jun. 12, 2021

(51) Int. Cl.
*B65D 19/38* (2006.01)

(52) U.S. Cl.
CPC .... *B65D 19/385* (2013.01); *B65D 2519/0097* (2013.01); *B65D 2519/00547* (2013.01); *B65D 2519/00796* (2013.01)

(58) Field of Classification Search
CPC ..... B65D 19/385; B65D 2519/00796; B65D 2519/0097; B65D 2519/00935; B65D 2519/0094; B65D 2519/0096; B65D 2519/00955; B65D 2519/00965
USPC ..... 108/53.1, 53.3, 53.5, 56.3
See application file for complete search history.

(56) References Cited

U.S. PATENT DOCUMENTS 2,579,655 A * 12/1951 Donald ..... B65D 19/12 108/53.5
3,565,018 A * 2/1971 Jay ..... B65D 19/385 108/53.5
3,665,869 A * 5/1972 Howe ..... B65D 88/129 108/53.5
3,857,494 A * 12/1974 Giardini ..... A47B 47/05 108/53.5
4,056,295 A * 11/1977 Downing ..... A47B 87/02 108/53.5
4,191,112 A * 3/1980 Maldonado ..... B65D 19/08 108/53.5
4,773,547 A * 9/1988 Bell ..... B65G 1/02 108/53.1

(Continued)

FOREIGN PATENT DOCUMENTS

EP 2899131 A1 * 7/2015 ..... B65D 19/06
KR 102248502 B1 * 5/2021
WO WO-2021096623 A1 * 5/2021

*Primary Examiner* — Jose V Chen

(57) ABSTRACT

The Self-Stacking SPACE Platform is an enclosure for safe storage and transportation of packaged goods or products used in logistic industries which eliminates the need of conventional pallets made up of wood or plastic and provides more stability, safety, and expanded utilization of space, referred to as density within the transportation vehicles, containers and storage warehouses, allowing more goods or products being stored or transported compared to present pallets. The Self-Stacking SPACE Platforms of present invention is stackable up to 4 high which is further comprised of: a rectangular base frame having a removable flooring sheet made of a light weight material such as plastic; a corner support member welded at each corner of the base frame to insert and secure at least one corner upright member to form a structure that behaves as a box like frame to enclose the goods or merchandise placed on the SPACE platform and also behaves as a pillars while stacking two or more platforms together. The SPACE platforms of present invention further includes plurality of forklift slots configured to allow lifting of the platform using any conventional forklift; a strap loop for strapping two or more SPACE platforms when stacked together; and a forklift shield provided to prevent damage to the goods or merchandise in case a fork of the forklift misses the forklift slot.

11 Claims, 5 Drawing Sheets

(56) References Cited

U.S. PATENT DOCUMENTS

| | | | | | |
|---|---|---|---|---|---|
| 5,507,237 | A * | 4/1996 | Barrow | B66C 1/16 | 108/55.3 |
| 5,906,165 | A * | 5/1999 | McCorkle, Jr. | B65D 19/12 | 108/55.1 |
| 6,202,569 | B1 * | 3/2001 | Bailey | B65D 19/385 | 108/53.5 |
| 6,325,224 | B1 * | 12/2001 | Brown | B65D 19/385 | 211/195 |
| 7,491,024 | B2 * | 2/2009 | Heinrichs | B65D 19/12 | 410/32 |
| 7,712,421 | B2 * | 5/2010 | Hartel | B65D 19/0073 | 108/51.11 |
| 2009/0000527 | A1 * | 1/2009 | Ficker | B65D 19/0016 | 108/57.25 |
| 2009/0057191 | A1 * | 3/2009 | Temple, Jr. | B65D 19/12 | 206/600 |
| 2010/0116178 | A1 * | 5/2010 | Harris | B65D 19/385 | 108/55.1 |
| 2011/0303129 | A1 * | 12/2011 | Harris | A47B 47/021 | 108/51.11 |
| 2015/0210426 | A1 * | 7/2015 | Funaki | B65D 19/06 | 108/53.3 |
| 2017/0190467 | A1 * | 7/2017 | Clark | B65D 19/04 | |
| 2019/0202597 | A1 * | 7/2019 | Wang | B65D 19/0028 | |

* cited by examiner

SELF-STACKING STRATEGICALLY PACKED AND COLLATED ENCLOSURE (SPACE) PLATFORM

FIELD OF THE INVENTION

The present invention relates to the field of shipping and transportation referred to as logistics. More specifically, the invention focuses attention on the platforms on which packages and products are placed and moved during the process of transportation/logistics. The invention provides a better platform for the packages and products because of corner posts, designed into the platform, to allow secure stacking of the platforms inside trucks, trailers, trains, air cargo planes and warehouse/fulfillment buildings. The secure stacking capability of the invention also means a near 100% utilization of vehicle space, known as density within the logistics business.

BACKGROUND OF THE INVENTION

The logistics business has not changed a great deal over the past decades. The industry continues to rely on wooden or plastic pallets, partly because it's just the way things are done, and partly because of their view that inexpensive pallets, albeit often used once, are a better business value than reusable pallets. The logistics market therefore predominantly uses wood or plastic pallets for stacking packages that are then secured in place with several layers of plastic wrap. They are then loaded only one level high if stacking is not possible, or are stacked two levels using the packages themselves as the structures bearing the load. These stacks often shift or tip during the trip, making unloading a much more difficult, time consuming, labor intensive, and as a result, expensive task. The current industry method places products on pallets and then wraps those pallets with clear plastic thus making it difficult to access inventory without slicing the plastic. Often too, pallets wrapped with plastic are stacked on top of one another meaning that the packages themselves are bearing the weight of the pallets above. Removing packages is therefore difficult, if not impossible, and can cause instability of the remaining load if one or more packages are removed or somehow shift out of position.

Further, the key importance in today's logistics market driven by the growth in online shopping, is the ability for online merchants to store inventory as well as backup inventory needed to supply products during heavy peak sales periods, when product supply needs can reach eight to ten times the off peak periods. Since the peak periods typically run for four months from October to January, the other two thirds of the year would find the costly racking sitting empty for eight months until the peak period arrives again. Progressive companies, desiring a change and wanting reusable pallets have unfortunately not strayed far from the normal wood pallet solution, instead only moving to plastic pallets. These plastic pallets put more plastic into a world which is already struggling to find a safe home for the millions of tons of plastic buried in landfills or put afloat in our oceans.

One such U.S. Pat. No. 5,351,628A discloses a wood and plastic pallet which are partially constructed of wood and partially constructed of plastic. A wooden upper deck is connected by two types of plastic spacer blocks to a wooden lower deck. The upper deck may be a conventional deck composed of stringers and slats or it may be a twin sheet thermoformed plastic deck. The lower deck is composed of stringers which underlie the plastic spacers and tie boards which abut the ends of the stringers. Connector spacer blocks serve both to join the upper deck to the lower deck and to connect the stringer boards to the tie boards. The stringers and tie boards are held in fixed relation by bolts which join the upper and lower decks passing through sockets in the spacer blocks. The stringers and the tie boards are bolted to the spacer blocks and are thus joined. The joint between the stringers and the tie boards may be strengthened by means of a metal link overlying the stringers and tie boards and linking the bolts together.

Patent application US20170203875A1 discloses a Transport and storage system that particularly relates to the field of the transportation and storage of goods and to a transport and storage system and, in particular, a system for the transportation and storage of goods such as palletized goods and self-standing goods. The present invention seeks to provide a system that can enable goods to be securely and reliably horizontally, vertically and offset stacked, despite different sizes of goods and support members therefore, such as pallets, whereby wasted volumes arising from the presence of irregular loads, pallets or pallets of different levels or different load ratings in storage and transport can be Minimized.

The problem associated with the prior technology is the use of plastic and wood for manufacturing the shipping modules and pallets. Further, there is a need for racks to store the traditional pallets loaded with products and wrapped with plastic. Stacking of the traditional pallets loaded with product and wrapped in plastic is not possible especially with heavy weighted products. Moreover, there is not a single prior disclosure disclosing a baseless shipping enclosure or enclosures with adjustable base that allows existing wooden or plastic pallets to be enclosed within the enclosure thus provided a secure and stable solution during transportation and then to be stacked upon each other when required for warehouse storage and fulfillment.

Therefore, there exists a need for a. Self-Stacking SPACE Platform that is made of a material not harmful for the society and environment as well as being reusable in nature and that provides alternative to the present wooden or plastic pallets. Further, there is a need for a Self-Stacking SPACE Platform that can be folded and stacked which can eliminate the need of permanent racks in warehouses.

SUMMARY AND OBJECT OF THE INVENTION

This summary is provided to introduce a selection, of concepts in a simplified form that are further disclosed in a brief description of the invention. This summary is not intended to identify key or essential inventive concepts of the claimed subject matter, nor is it intended for determining the scope of the claimed subject matter.

The Self-Stacking SPACE Platform disclosed herein addresses the above mentioned need of a reusable shipping platform that provides an alternative to the wooden or plastic pallets currently being used in logistic market. Further, it discloses Self-Stacking SPACE Platforms that are foldable when required and stackable upon each other thus eliminating the need for expensive permanent racks that take up unnecessary floor space in the warehouses/fulfillment buildings.

According to one exemplary embodiment, the Self-Stacking SPACE Platform is comprised of; a steel frame or base with four square sockets or corner supports welded on all four corners of the base, four uprights with an inverse pyramid shaped female pocket at the top and a male pyramid shaped target at the bottom of each upright which is capable of being inserted and locked within the four square corner support of the base therefore making it a rigid and stable enclosure module for the purposes of offering the stability of shipment and stackable feature when in storage. A floor attaching permanently to the base of the module according to one embodiment and removable attachable according to one another embodiment of the enclosure module, a fork slots on all four sides of the base to allow lifting of the Self-Stacking SPACE Platform using conventional fork lift and a plurality of shields above the fork lift slots on all the sides to prevent damage to the product or carton present over the platform in the events when forklift misses the forklift slot.

According to one exemplary embodiment, the Self-Stacking SPACE Platform of present invention is made of a powder coated steel or aluminum or any material according to the load needs to be enclosed and shipped within it. According to one exemplary embodiment, the Self-Stacking SPACE Platform comprises removable bottom that sits inside the base of the Self-Stacking SPACE Platform which can be easily removed to decrease weight to the platform when it is not in use. According to one embodiment, the self-stacking SPACE platform further includes a plurality of strap loops configured on the bottom wall of each side bars of the base frame which is configured to allow secure two or more units of SPACE platforms together for shipping when stacked too high.

By utilizing the present invention online merchants can sort and load online orders by zip code and place them onto a dedicated. Self Stacking SPACE Platform for that zip code destination. All zip coded platforms for a specific metropolitan area will ship on a truck to the metropolitan area transfer hub. Since the packages were sorted, routed and packed already, the Self-Stacking SPACE Platform can be placed inside the delivery vehicle at the metropolitan transfer hub for final delivery. The Self-Stacking SPACE Platform therefore reduces the number of human touches, ships all truckloads at near 100% capacity, and streamlines the logistics and reduces the time and expense of getting online orders to the customers for final delivery.

The object of the present invention is to provide a Self-Stacking SPACE Platform that is capable of being stacked 4 high without the need for any additional and very expensive racking.

Another object of the present invention is to provide a. Self-Stacking SPACE Platform that is environmental friendly as there is no plastic wrap required to secure the loads when inserted into the self-stacking SPACE Platform.

One another object of the present invention is to provide a Self-Stacking SPACE Platform that is designed to provide a platform that could be pre-packed outside of the last mile delivery vehicle, or in fact any delivery vehicle, using routing software where the software allows the platform to be strategically loaded so the package for each stop can be easily accessed by the driver in the exact route preplanned by the routing software.

Yet another object of the present invention is to provide a Self-Stacking SPACE Platform that is designed to meet the size requirements of any type of vehicle from delivery vans to large vans, step vans, panel trucks, semi-trailers and even trains, planes and shipping containers.

Yet one another object of the present invention is to provide Self-Stacking SPACE Platforms that provide valuable solutions for online merchants, brick and mortar retailers, shipping companies and last mile delivery services as the SPACE platform of present invention is capable to perfectly fit within the shipping containers used for ocean going container ships. Because of the fact that the SPACE platform stack securely two high inside the containers, the danger of cargo shifting inside the container is minimized or removed completely when shipping products on SPACE platforms as 20 SPACE platforms fits inside the standard 40 foot steel container when stacked two high resulting in use of 100% capacity of each container to add value to shippers.

Yet one another object of the present invention is to provide a Self-Stacking SPACE Platform that gives products heading to market a safe, stable and easy to load and store solution far superior to standard methods used in logistics.

Yet one more object of the present invention is to provide a Self-Stacking SPACE Platform that provides ability to the vendors to ship their products without outer packaging, if desired, since the enclosure Self-Stacking SPACE Platforms can accept custom egg crating dividers designed to the exact size of the product. The removal of unnecessary packaging is not only good for the environment, but also reduces the expense of labor to remove and dispose of the outer packing.

Yet one more object of the present invention is to provide a Self-Stacking SPACE Platform that provides a very desirable attribute for Online Merchants or Retail Stores who face peak times during the year when 8 to 10 times inventory is required to meet demands.

Another object of the present invention is to provide returnable and reusable Self-Stacking SPACE Platforms that can collapse down to 13" or less in height, thus compressing the size to make handling easier; take up less space on return vehicles, and save shipping and labor costs.

One object of the present invention is to provide Self-Stacking SPACE Platforms with stacking ability meaning more stability when inside a semi-trailer, railcar, cargo airplane or warehouse to prevent tipping or sliding that often happens with the current standard logistics solution using wooden or plastic pallets that are wrapped in plastic.

One more object of present invention is to provide Self-Stacking SPACE Platforms which includes a slotted acceptor system or corner support at all four corners, wherein each corner support has two slots to ensure the secure placement of the upright and to prevent it to tilt out of alignment.

One more object of present invention is to provide Self-Stacking SPACE Platform wherein the corner uprights may lift and drop onto the frame for storing and for return shipment.

BRIEF DESCRIPTION OF DRAWINGS

The foregoing summary, as well as the following detailed description of the invention, is better understood when read in conjunction with the appended drawings. For the purpose of merely illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF INVENTION

Figure 1:
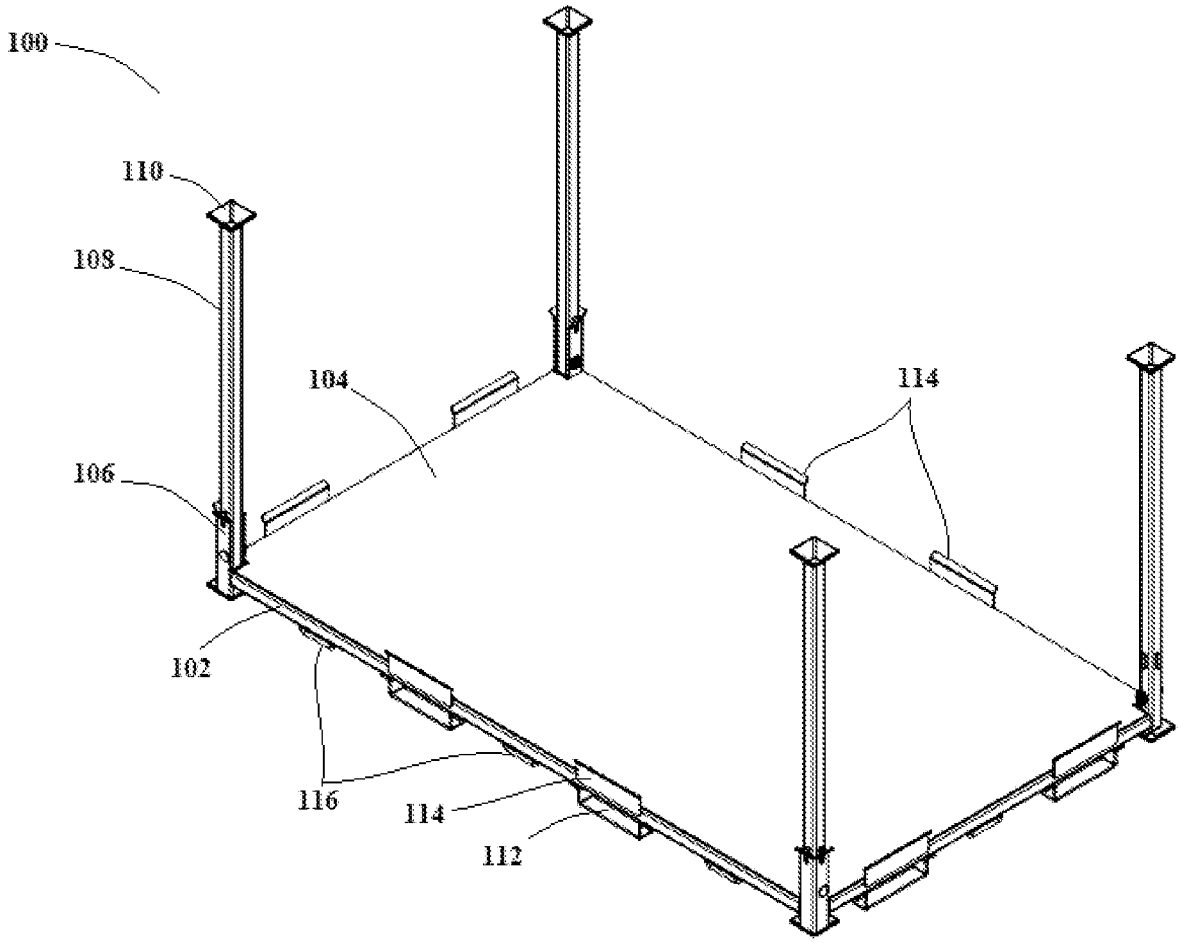
FIG. 1 exemplarily illustrates top isometric view of one embodiment of the strategically packed and collated enclosure (SPACE) module of present invention.

The present invention overcomes the aforesaid drawbacks of the above, and other objects, features and advantages of the present invention will now be described in greater detail. Also, the following description includes various specific details and are to be regarded as merely exemplary. Accordingly, those of ordinary skill in the art will recognize that: without departing from the scope and spirit of the present disclosure and its various embodiments there may be any number of changes and modifications described herein.

The Self-stacking strategically packed and collated enclosure (SPACE) platform disclosed by the present invention is provided to give products heading to the market a safe, stable and easy to load solution far superior than the standard methods, wooden or plastic pallets or any other product which is being used in logistics industries. According to one embodiment, it provides valuable solutions for online merchants, brick and mortar retailers, shipping companies and last mile delivery services.

According to one embodiment, the SPACE platform of present invention is capable of being utilized to sort and load online orders by the online merchants based on their zip codes on dedicated SPACE platform for said zip code destination. According to one embodiment, because of the shape and stackable feature of present SPACE platform, it allows easy streamlining of the logistics and also reduces the time and expense of getting online orders to the customers for final delivery.

According to one embodiment, the SPACE platform of present invention is comprising of: a rectangular four-sided base frame with a removable floor sheet made of the plastic to be placed over the base frame. According to one embodiment, the SPACE platform of present invention further includes corner supports welded on all four corners of the base frame to accept the corner uprights, wherein a pyramid shaped male targets are fixed at the bottom of each corner support while the top is made as a rectangular shaped hollow enclosure with three side walls to secure the corner uprights at its place. A corner upright to be configured at each corner of the base frame and placed within the corner support, wherein the upright further includes a pyramid shaped female target which is provided to conform with the male target at the bottom of the corner support when two SPACE platform are stacked together to provide better stability and safety.

According to one embodiment, the SPACE platform of present invention further comprises a forklift slots mounted at the bottom wall of the base frame and configured to allow lifting of the SPACE platform using the conventional forklift; at least one upright shield member configured at the top of all four sides of the base frame with an inclined top at an angle of 45 degree outward to the base frame which is provided to prevent damage to the cartons and other delicate goods which needs to be handled with care; and a plurality of strap loops also attached at the bottom wall of the base frame beside the forklift slots which are configured to allow belting two SPACE platforms together when stacked for shipping, hence increasing stability and safety during transportation.

According to one embodiment, the base of the Self-Stacking SPACE Platform is fixed at the bottom of the platform to allow the packages or products to be stacked directly over the base plate and enclosed within the Self-Stacking SPACE Platform. Further, according to one another embodiment of the present Self-Stacking SPACE Platform the base of the enclosure module is removable allowing the flooring of the platform to be removed when not in use. Moreover, perforated plastic sheets are used as a removable base plate that is necessary to allow water to drain through the base. Furthermore, fork-lifting of the Self-Stacking SPACE Platform is possible even when no pallet is placed inside since the base comprises a fork slots on all four side as mentioned above.

According to one embodiment, the top of the corner upright is made as a female pocket or target of the shape of inverse pyramid while the bottoms of each corner support members are made as a male pocket or target of the shape of pyramid which sits and conform within the female pocket at the top of the other SPACE platform when two SPACE platforms are stacked over each other. This secure sitting of pyramid shaped male target within the female pocket when stacked increases stability and rigidity of the platforms. This method of stacking has been tested to allow secure and stable stacking of up to four Self-Stacking SPACE platforms according to present embodiment and may vary according to the load type, weight and the material being used in manufacturing of the Self-Stacking SPACE Platform. Most preferably, the material is selected from the powder coated steel, aluminum, iron, or alloy made therefrom, but without departing from scope of the invention, any metal can be used that allows reusability of the Self-Stacking SPACE Platform and non-hazardous to the environment and eliminates the need of wood or plastic.

Referring to FIG. 1 which illustrates top isometric view of SPACE module or platform 100 of present invention. According to present embodiment, the SPACE platform 100 is made of a rectangular base frame 102 with a removable flooring sheet 104 and a corner support members 106 welded at each corner of the rectangular base frame 102, wherein each of the corner support member 106 is configured to secure a corner upright member 108 to form a platform which may securely enclose the cartons and products to be delivered in e-commerce business or in any other logistic business. According to one embodiment, the flooring sheet 104 is made of a plastic to decrease the weight of the SPACE platform.

According to present embodiment, the corner support member 106 is made as a square socket at the top to accept and secure the corner upright members 108 and enclose it from three sides while keeping one side open as to allow the corner support members 108 to be lifted up from the square socket and dropped onto the frame for storing or during return shipment of the SPACE platforms. According to one embodiment, the corner upright member 108 of present invention further includes an inverse pyramid shaped socket which is configured to allow rigid and secure stacking of SPACE platforms.

According to one embodiment, the SPACE platform of present invention further includes plurality of forklift slots 112 and strap loops 116 affixed at the bottom wall of each side of the base frame 102. According to one embodiment, the forklift slots are provided to allow easy lifting of the SPACE platform 100 using any conventional forklift. According to one embodiment, the strap loops are configured to allow strapping of belting at least two SPACE platforms together when stacked for shipping.

According to one embodiment of present invention, plurality of forklift shields 114 are affixed aligned to each forklift slots 112 over all the sides of the base frame 102 of the SPACE platform. The forklift shields 114 according to one embodiment of present invention is provided to protect the merchandise and/or cartons placed on the SPACE platform 100 from being damaged in the event the fork misses the forklift slot 112.

Figure 2:
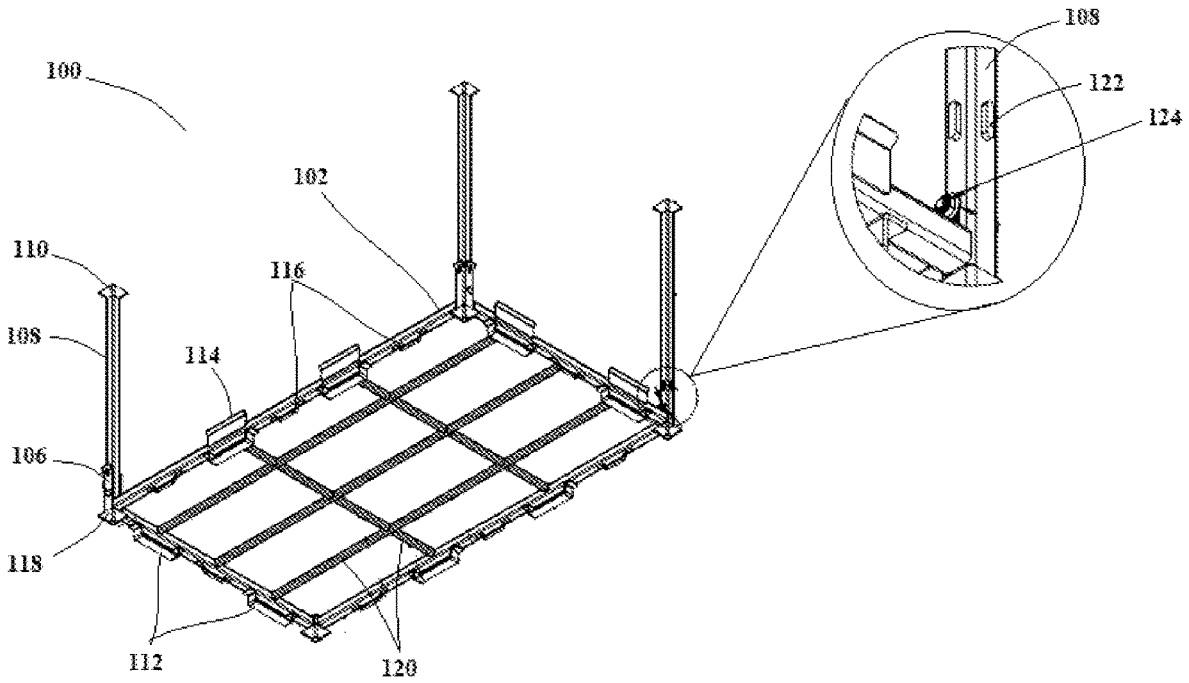
FIG. 2 exemplarily illustrates bottom isometric view of the strategically packed and collated enclosure module with a zoom in view of a connection of upright member at with the main frame at the corner support of present invention.

FIG. 2 exemplarily illustrates bottom isometric view of the SPACE platform 100 with a zoomed in view of a connection of upright member 108 with the main frame 102 at the corner support 106 of present invention. According to present embodiment, the corner upright member 108 of present SPACE platform 100 includes an oval shaped studs 122 welded at three sides of each corner upright members 108 neat the bottom. According to one embodiment, the two sides of the top square pocket of each corner support member 106 further includes an oval shaped apertures for placement and securing the oval shaped welded stud 122 of the corner support member 108 thus safely securing the corner upright member 108 within the top square pocket of the corner support member 108.

According to one embodiment, the bottom end of each corner support member 106 is provided with bottom extending pyramid shaped target 118 which is provided to sit within the female inverse pyramid shaped socket 110 of corner upright members of another SPACE platform 100 when stacked together on each other. According to one embodiment, the Pyramid and inverse pyramid shape of the mala target and female socket provide additional locking capacity, stability and rigidity to the SPACE platforms 100 when stacked.

The base frame 102 further includes a net structure made of plurality of bars 120 affixed in horizontal and vertical placements. According to one embodiment, the SPACE platform further includes a nut-bolt assembly 124 provided to fasten the corner upright member 108 with the corner support member 106 for additional safety. According to one embodiment, the corner support member 106 and the corner upright member both includes equal-centric holes on any two opposite walls that allows nut of the nut-bolt assembly 124 pass from one side and extend out to another side through the corner upright member secured in the corner support member, wherein the bolt of the nut-bolt assembly 124 is secured on the extending thread of the nut thus fixing the corner upright member 108 tightly within the corner support member 106 preventing its movement.

Figure 3:
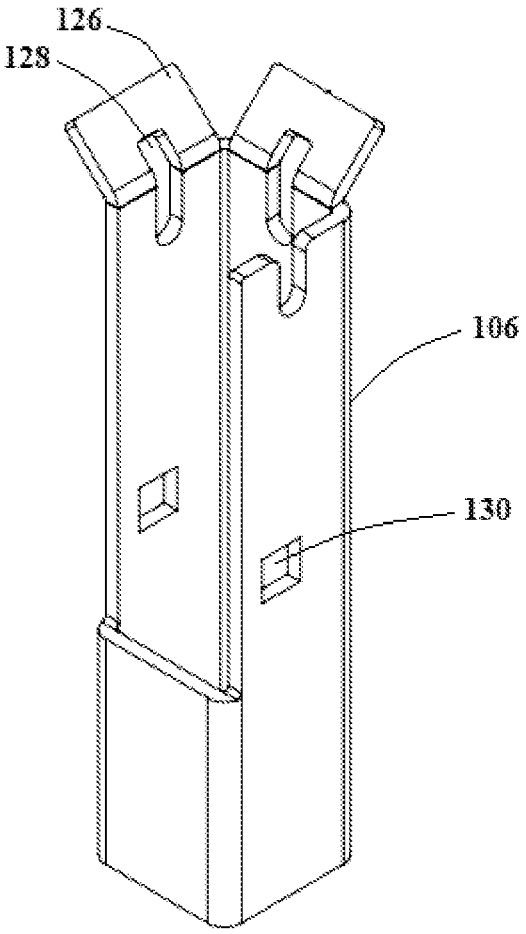
FIG. 3 shows view of a corner support member of present. SPACE platform.

FIG. 3 shows view of a corner support member 106 of present. SPACE platform 100. The corner support member 106 as shown is provided to secure the corner upright member 108 thus made in the shape rectangle upright with a square socket or opening for easy installation of corner upright member, wherein the three walls of the corner support member 106 encloses the corner upright member, while the one open side allows lift and drop of the corner upright member 108 over the base frame 102, when the SPACE platform 100 is not in use.

According to one embodiment, top portions 126 of two adjacent walls of the corner support members 106 are tilted at 45 degrees in outward direction which is designed to guide the corner upright member 108 into position and also to make it easier to insert the upright into the corner support member 106. According to one embodiment, an oval shaped aperture 128 is provided in both the adjacent walls having the tilted top portion 126 which is configured to secured oval shaped studs of the corner upright member 108 when inserted within the corner support member 106. Additionally, pair of eccentric holes 130 in two opposite walls of the corner support member 106 which is configured to allow nut of the nut-bolt assembly to pass through the corner support member 106.

Figure 4:
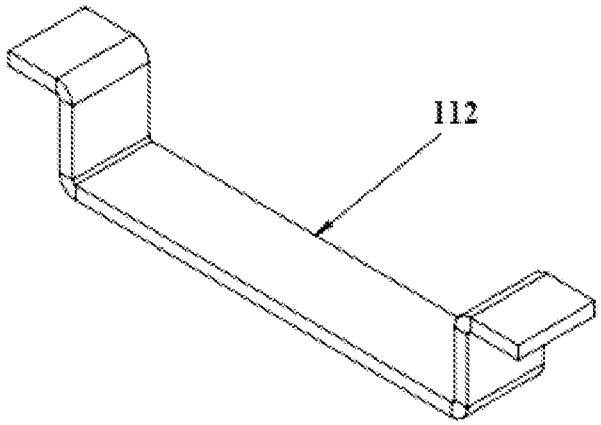
FIG. 4 illustrates view of a forklift slot of present SPACE platform.
Figure 5:
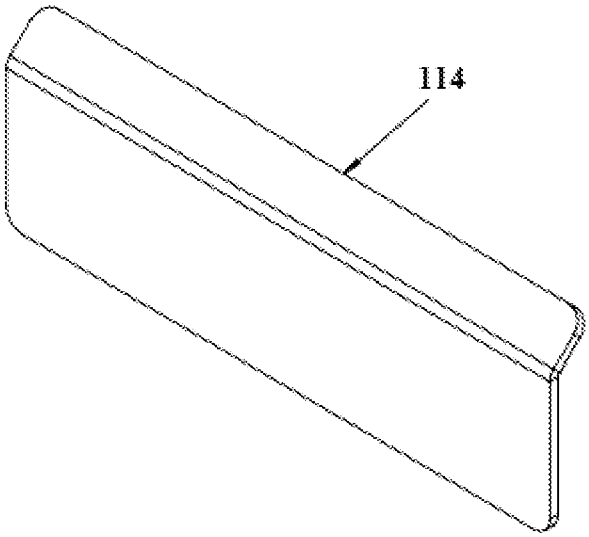
FIG. 5 illustrates view of a shield member of present SPACE platform.
Figure 6:
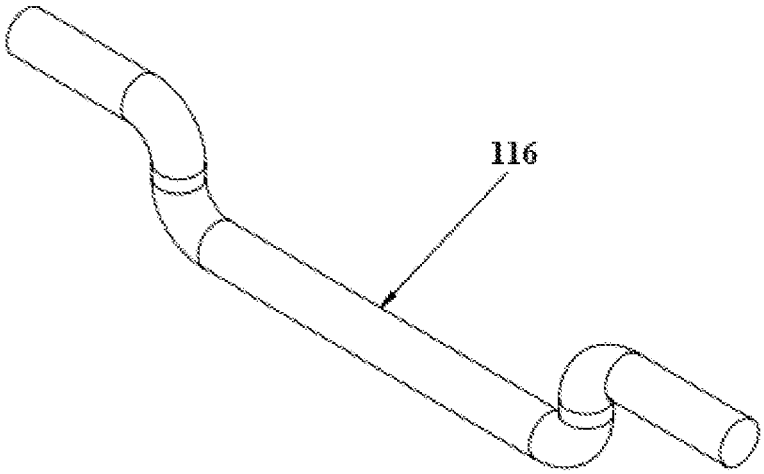
FIG. 6 shows view of a strap loop of present SPACE platform.

FIG. 4 shows view of a forklift slot 112 of present SPACE platform 100 which gets affixed at the bottom wall of the base frame 102 of the SPACE platform 100. According to one embodiment, the SPACE platform of present invention includes a plurality forklift slots 112 at bottom of each side of the base frame 102. FIG. 5 illustrates view of a shield member 114 which is provided to get configured over the base frame aligned to the forklift slot 112 to prevent damage of the cartons placed over the SPACE platform 100 when fork misses the forklift slot 112. While, FIG. 6 shows view of a strap loop 116 which is provided for belting two or more SPACE platforms 100 when stacked over one another.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

The invention claimed is:

1. A Self-stacking strategically packed and collated enclosure (SPACE) platform for storage and transportation of a packaged goods and merchandise, comprising:

a rectangular base frame with a removable floor sheet;

at least one corner support member welded at each corner of the rectangular base frame; and at least one corner upright member provided to be mounted within at least one corner support member and affixed using a nut-bolt assembly to form a structure that may enclose the packaged goods and merchandise safely on the SPACE platform wherein each of the at least one corner support member comprises a square socket at a top to accept and enclose the at least one corner upright member, wherein the square socket comprises a three side walls and one side open for the enclosed corner upright member to fold down onto the rectangular base frame from the open side.

2. The SPACE platform of claim 1 further comprises plurality of forklift slots attached at a bottom wall of each side of the base frame configured to allow lifting of the SPACE platform using a forklift.

3. The SPACE platform of claim 1 further comprises at least one upright shield member affixed at a top of the base frame aligned to each of the plurality of forklift slots.

4. The SPACE platform of claim 3, wherein each of the upright shield member is tilted at an angle outward to the base frame.

5. The SPACE platform of claim 3, wherein each of the upright shield member is provided to prevent damage to the packaged goods and merchandise placed in events of a fork miss any of the plurality of forklift slots.

6. The SPACE platform of claim 1 further comprises plurality of strap loops affixed at the bottom walls of each side of the base frame which is configured to allow belting of at least two SPACE platforms together when stacked.

7. The SPACE platform of claim 1, wherein a top portion of two adjacent walls of the square socket are tilted outward to guide the at least one corner upright member to allow easy insert into the SPACE platform.

8. The SPACE platform of claim 7, wherein each of the two adjacent walls of the square socket with the tilted portion further includes at least one oval shaped aperture to secure the oval shaped stud of the at least one corner upright member enclosed in the square socket.

9. The SPACE platform of claim 1, wherein the at least one corner upright member further includes an oval shaped stud welded at two adjacent sides.

10. The SPACE platform of claim 1, wherein the at least one corner support member and at least one corner upright member includes an apertures on two opposite walls, wherein the apertures of the corner support member and corner upright member aligns when the corner upright member is inserted into the corner support member.

11. The SPACE platform of claim 10, wherein the apertures of the at least one corner support member and at least one corner upright member is provided to pass a nut through the aligned holes and fasten using a bolt of the nut-bolt assembly after inserting he corner upright member into the corner support member.

* * * * *